US007353607B2

(12) United States Patent
So

(10) Patent No.: US 7,353,607 B2
(45) Date of Patent: Apr. 8, 2008

(54) CAN OPENER

(75) Inventor: Kwok Kuen So, Kowloon (HK)

(73) Assignee: Progressive International Corporation, Kent, WA (US)

( * ) Notice: Subject to any disclaimer, the term of this patent is extended or adjusted under 35 U.S.C. 154(b) by 219 days.

(21) Appl. No.: 10/996,992

(22) Filed: Nov. 23, 2004

(65) Prior Publication Data

US 2006/0064883 A1 Mar. 30, 2006

(51) Int. Cl.
*B67B 7/72* (2006.01)

(52) U.S. Cl. ..... 30/416; 30/418; 30/433

(58) Field of Classification Search ..... 30/415–418, 30/420, 422, 426, 433
See application file for complete search history.

(56) References Cited

U.S. PATENT DOCUMENTS

| | | | | | |
|---|---|---|---|---|---|
| 2,522,382 | A | * | 9/1950 | Lampl | 30/422 |
| RE27,504 | E | * | 10/1972 | Smith | 30/15.5 |
| 5,970,618 | A | * | 10/1999 | Kuo | 30/434 |
| 6,101,727 | A | * | 8/2000 | Chong | 30/418 |
| 6,148,527 | A | * | 11/2000 | Pereira | 30/417 |
| 6,851,195 | B2 | * | 2/2005 | So | 30/418 |
| 2002/0088127 | A1 | | 7/2002 | Wilson | |

FOREIGN PATENT DOCUMENTS

| | | | |
|---|---|---|---|
| GB | 613146 | | 4/1946 |
| GB | 2161449 | * | 1/1986 |
| WO | WO 03/043929 | | 5/2003 |

* cited by examiner

*Primary Examiner*—Kenneth E. Peterson
*Assistant Examiner*—Phong Nguyen
(74) *Attorney, Agent, or Firm*—Black Lowe & Graham, PLLC

(57) ABSTRACT

A can opener (100) has two pivotal handles (110 and 120), a traction wheel (200) and a cutter blade (300) movable by respective handles (110 and 120) for cutting open a can, and a pivotable lever (400). There is a ratchet assembly (500) driven by the lever (400) upon reciprocation for operating the traction wheel (200) and cutter blade (300), which has a ratchet wheel (510) connected with the traction wheel (200) and a spring-loaded pawl (520) movable by the lever (400) for turning the ratchet wheel (510) in a driving direction (D) upon reciprocation of the lever (400). The pawl (520) has front and rear ends (521 and 522) taken in the driving direction (D), with the front end (521) in engagement with the lever (400) and the rear end (522) engageable with the ratchet wheel (510) for turning the same.

8 Claims, 5 Drawing Sheets

CAN OPENER

PRIORITY CLAIM

This application claims the benefit of prior United Kingdom Application Ser. No. 421717.0 filed Sep. 30, 2004.

FIELD OF THE INVENTION

The invention relates to a manually operable can opener.

BACKGROUND OF THE INVENTION

Can openers have been known for many years, and the typical construction includes a traction wheel for turning a can and a disc-like cutter blade for rotation while the can is being turned to cut open the can. Conventionally, the traction wheel is turned by means of an operating member mostly in the form of a wing knob. Can openers that can be operated by pivoting a lever or the like are not new, for example as disclosed in published patent specifications GB 613,146, U.S. Pat. No. 5,970,618, WO 03/043,929 A1 and US 2002/0088127 A1. None of these can openers survive for various reasons, probably mainly because that they are not reliable in construction or operation and/or are difficult to use.

The invention seeks to obviate or at least alleviate some of such shortcomings by providing a new or improved can opener.

SUMMARY OF THE INVENTION

According to a preferred form of the invention, there is provided a can opener comprising first and second handle members pivotal with respect to each other, and a rotatable traction wheel and a rotatable cutter blade movable by the first and second handle members respectively between an inoperative position in which the wheel and the blade are spaced apart for receiving an edge of a can to be opened and an operative position in which the wheel and the blade are close together for turning and cutting the edge of said can. An operating member is supported for pivotal reciprocation relative to the handle members. Also included is a ratchet assembly arranged to be driven by the operating member upon reciprocation for operating the traction wheel and the cutter blade. The ratchet assembly comprises a ratchet wheel in engagement with the traction wheel and a spring-loaded pawl movable by the operating member for turning the ratchet wheel in a driving direction upon reciprocation of the operating member. The pawl has front and rear portions taken in the driving direction, with the front portion in engagement with the operating member and the rear portion engageable with the ratchet wheel for turning the ratchet wheel.

Preferably, the pawl lies generally parallel and close to an adjacent periphery of the ratchet wheel.

It is preferred that the rear portion of the pawl comprises a hook-shaped end for engaging the ratchet wheel.

Preferably, the ratchet assembly includes a spring acting upon the pawl at its rear portion for resiliently biasing the pawl into engagement with the ratchet wheel.

It is preferred that the operating member is pivotable about an operating axis and is spaced apart from the ratchet assembly in a direction parallel to the operating axis. In a preferred embodiment, the ratchet assembly includes a base on which the ratchet wheel and the pawl are held, the base being pivotable by the operating member upon reciprocation.

More preferably, the base is fixedly connected to the operating member by means of a shaft that extends along the operating axis.

It is advantageous that the ratchet assembly is positioned between the operating member and the traction wheel in a direction parallel to the operating axis.

Preferably, the operating member is pivotable and the traction wheel rotatable about the same axis.

In a preferred embodiment, the first and second handle members have respective frontmost ends that are pivotably connected, and the operating member is pivotably connected to the first handle member at a position to one side thereof and falling short of its frontmost end.

More preferably, the first and second handle members have respective front end portions which together expand into a bulbous chamber locating the ratchet assembly and to which the traction wheel and the cutting blade are individually attached.

BRIEF DESCRIPTION OF THE DRAWINGS

Preferred and alternative embodiments of the present invention are described in detail below with reference to the following drawings.

The invention will now be more particularly described, by way of example only, with reference to the accompanying drawings, in which.

DETAILED DESCRIPTION OF THE PREFERRED EMBODIMENT

Figure 1:
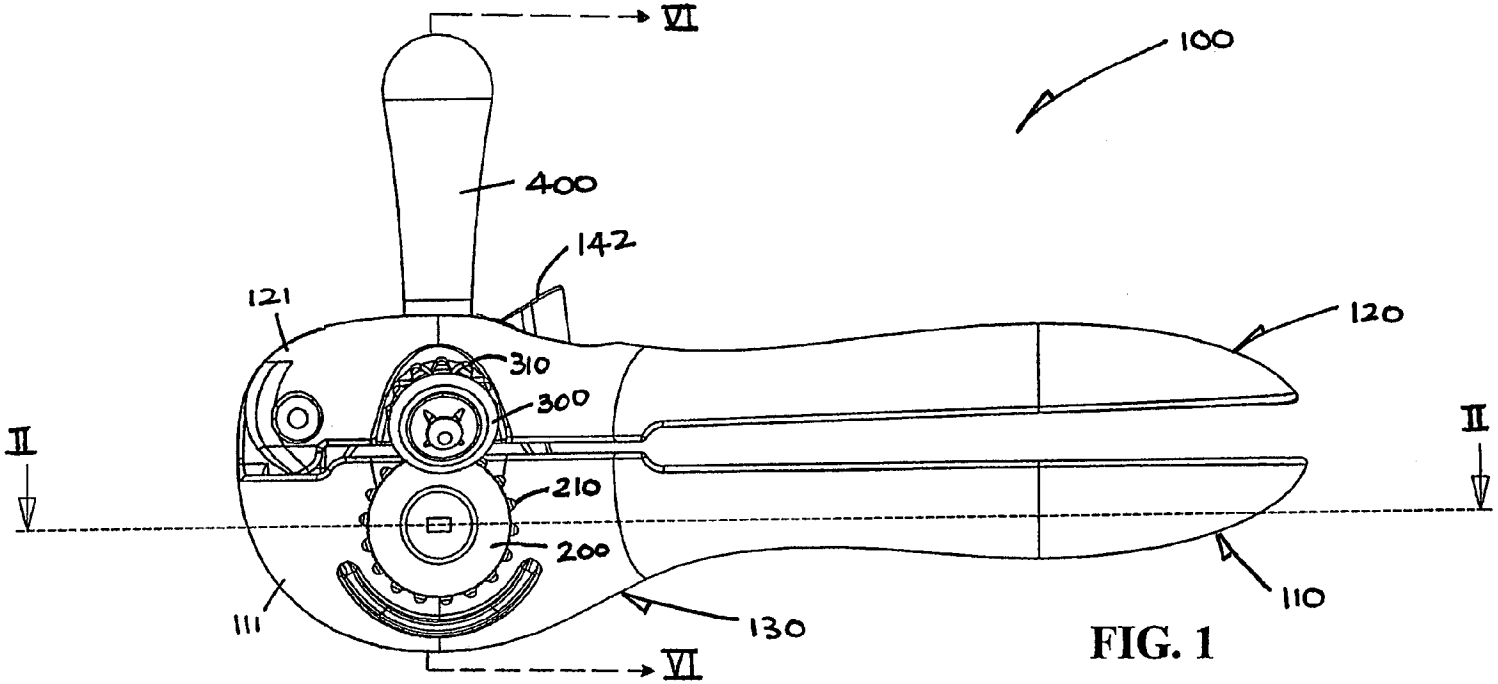
FIG. 1 is a left side view of an embodiment of a can opener in accordance with the invention.
Figure 2:
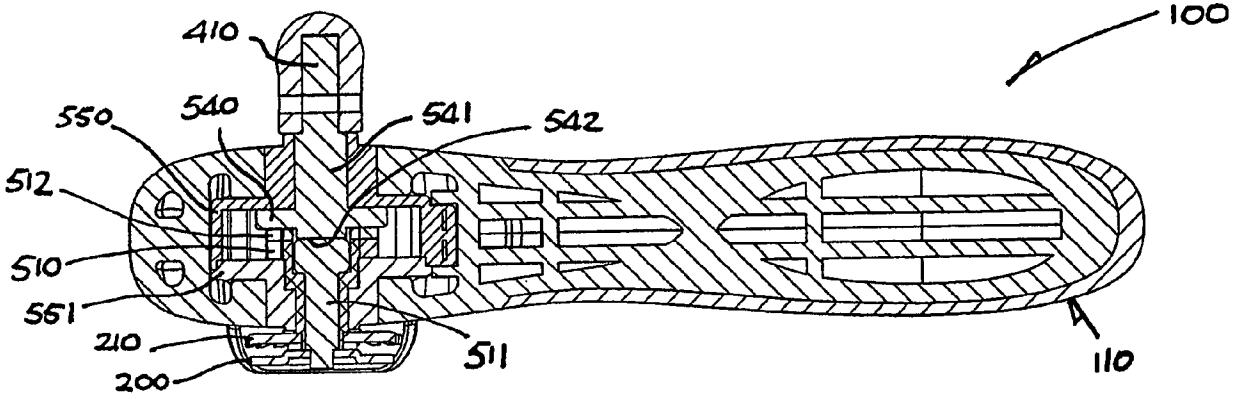
FIG. 2 is a cross-sectional view of the can opener of FIG. 1, taken along line II-II.
Figure 3:
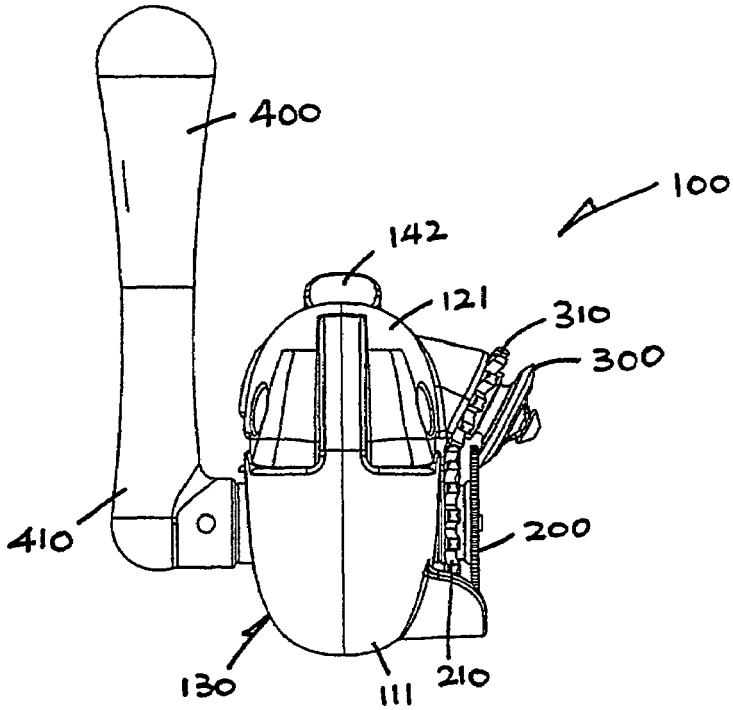
FIG. 3 is a front end view of the can opener of FIG. 1.
Figure 6:
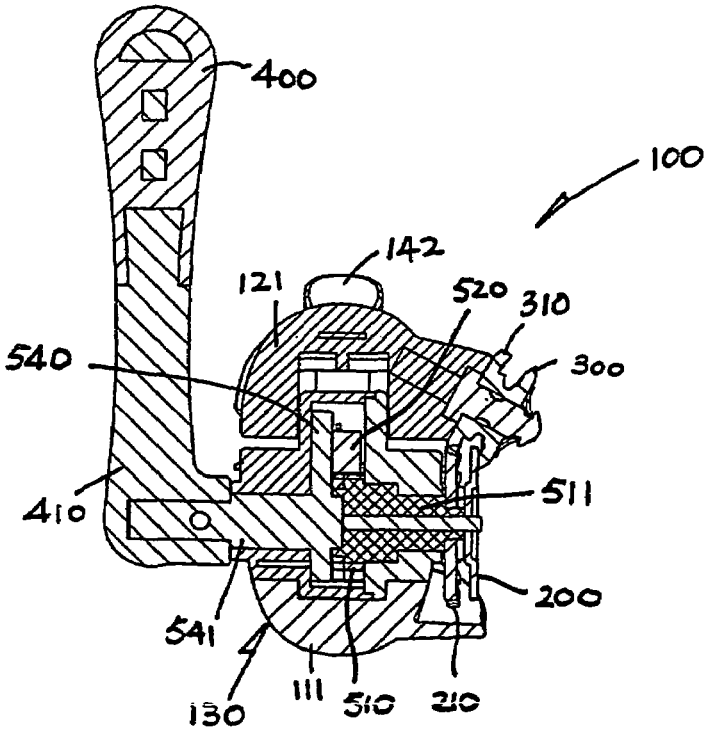
FIG. 6 is a cross-sectional view of the can opener of FIG. 1, taken along line VI-VI.
Figure 4:
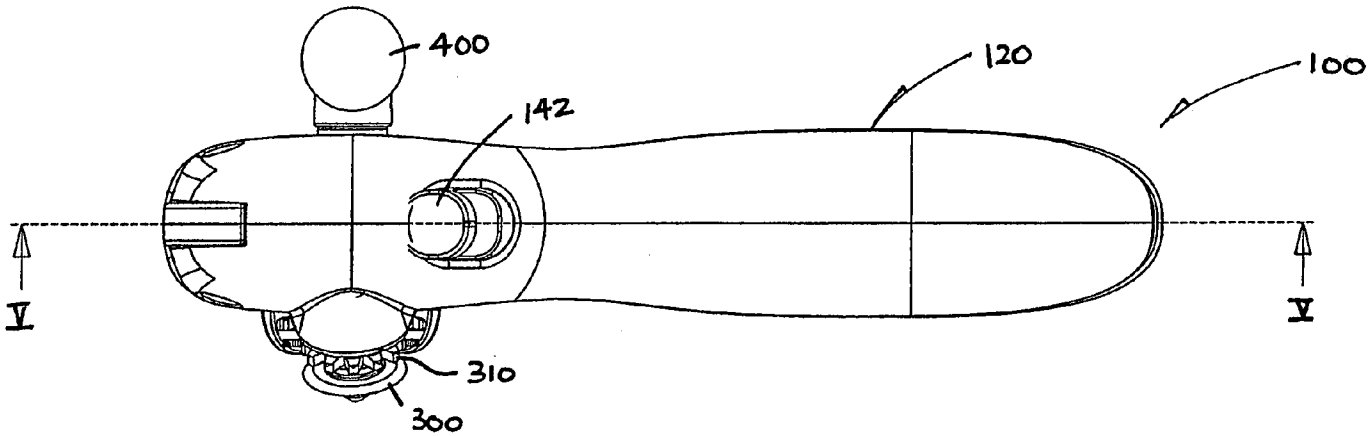
FIG. 4 is a top plan view of the can opener of FIG. 1.
Figure 5:
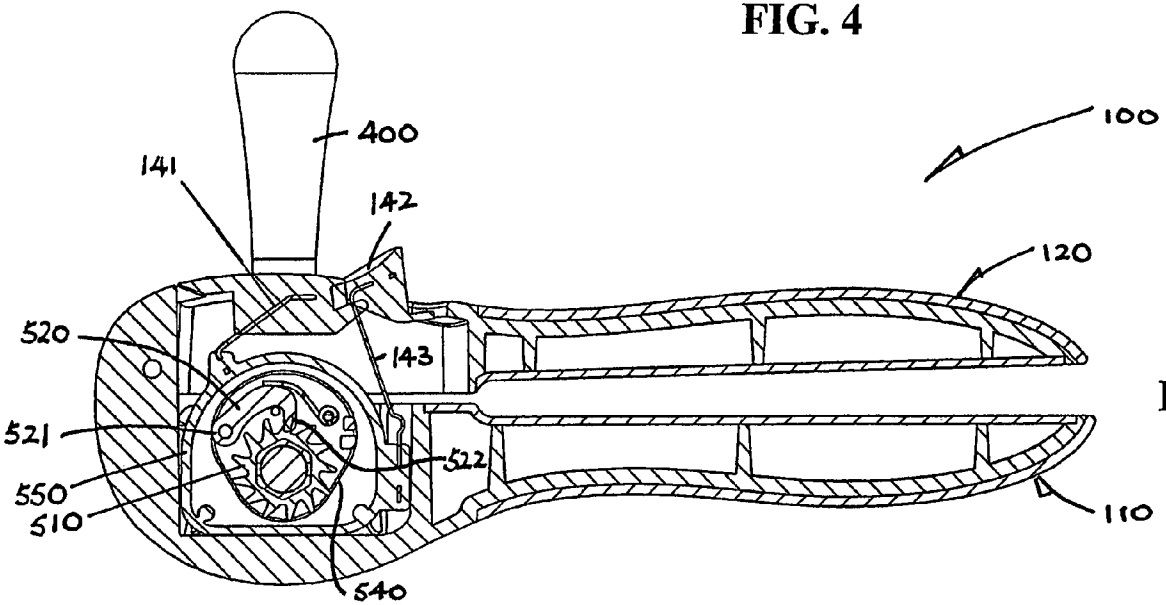
FIG. 5 is a cross-sectional view of the can opener of FIG. 4, taken along line V-V.
Figure 7:
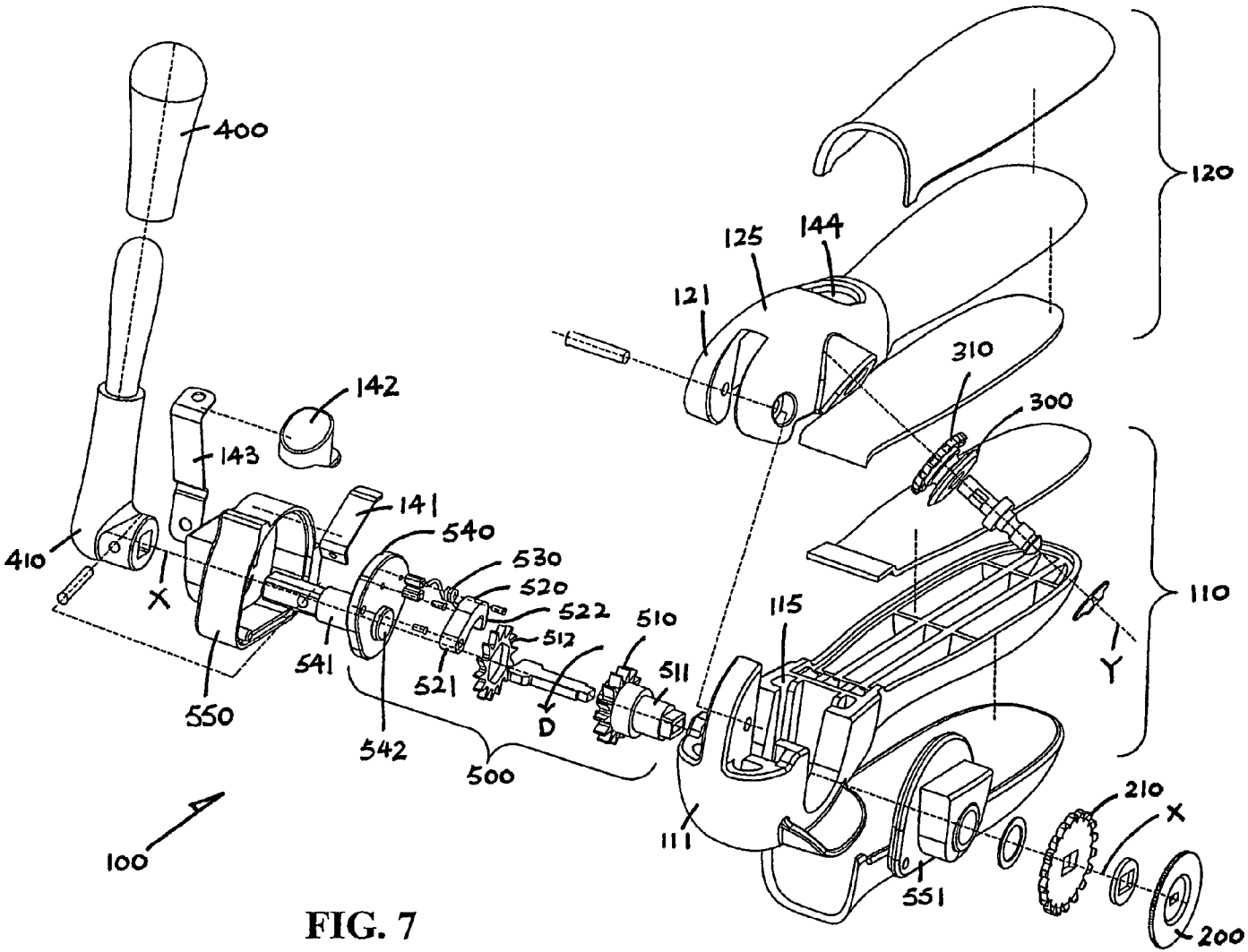
FIG. 7 is an exploded perspective view of the can opener of FIG. 1.

Referring to the drawings, there is shown a can opener 100 as an exemplary embodiment of the invention, which comprises a pair of bottom and top elongate handle members 110 and 120 hinged together at their frontmost ends 111 and 121 for pivotal movement with respect to each other, and a rotatable traction wheel 200 and a rotatable cutter blade 300 mounted behind the frontmost ends 111 and 121 of the bottom and top handle members 110 and 120 respectively for movement thereby. The wheel 200 and the blade 300 are movable between an inoperative position in which the wheel 200 and the blade 300 are spaced apart for receiving an edge of a can to be opened and an operative position in which the wheel 200 and the blade 300 are close together for turning and cutting the edge of the can.

Both handle members 110 and 120 are made sufficiently broad and to have an oval cross-section jointly for easy and comfortable gripping by a user. Their front end portions 115 and 125 together expand to form a bulbous chamber 130, to which the traction wheel 200 and the cutting blade 300 are individually attached. The wheel 200 and the blade 300 are rotatable about respective axis X and Y. They are fitted with respective co-axial gearwheels 210 and 310 for mating in the operative position such that the blade 300 will rotate simultaneously with the wheel 200, when the latter is being rotated by the user. Axis X lies horizontally during normal use of the can opener 100, whereas axis Y extends at small acute angle downwardly with respect to axis X.

The can opener 100 includes an operating lever 400 supported for pivotal reciprocation relative to the handle members 110 and 120, and a ratchet assembly 500 arranged to be driven by the lever 400 upon reciprocation for operating the traction wheel 200 and the cutter blade 300. The lever 400 is connected at its lower end 410 to the bottom handle member 110 at a position to the right side thereof and falling short of its frontmost end 111, for pivotal movement about axis X.

The ratchet assembly 500 has a ratchet wheel 510 in co-axial engagement with the traction wheel 200, a pawl 520 movable by the operating lever 400 for turning the ratchet wheel 510 in a driving direction D upon reciprocation of the lever 400, and a spring 530 resiliently biassing the pawl 520 into engagement with the ratchet wheel 510. Also included are a base plate 540 on which the ratchet wheel 510 and the pawl 520 are held, and a generally flat casing 550 (having a left side lid 551) encasing all the other ratchet components 510 to 540.

The ratchet assembly 500 is fitted in the handle chamber 130, being largely located within the bottom handle portion 115. The base plate 540 is connected by an integral transverse shaft 541 to the lower end 410 of the operating lever 400 for pivotal movement thereby, said shaft 541 extending along axis X through a right side support hole of the casing 550 and the bottom handle portion 115. By means of the shaft 541, the lever 400 is spaced apart from the ratchet assembly 500 in a direction parallel to axis X.

The ratchet wheel 510 has a transverse shaft 511 which extends along axis X through a left side support hole of the casing 550 and the bottom handle portion 115, on which shaft 511 externally the traction wheel 200 and associated gearwheel 210 are mounted fast for rotation with the ratchet wheel 510. The ratchet assembly 500 is positioned between the operating lever 400 and the traction wheel 200 in a direction parallel to axis X.

Whilst the ratchet wheel 510 and shaft 511 are molded from plastics material, the wheel 510 is reinforced by a metal wheel 512 fixed against its side of identical shape and size for co-operation with the pawl 520 that is made of metal. The base plate 540 includes a flat integral boss 542 centered at axis X about which the strengthening wheel 512 is disposed, whereby the ratchet wheel 510 is also rotationally supported on its inner side.

A horizontal leaf spring 141 at the top of the ratchet casing 550 urges the top handle member 120 to pivot away from the bottom handle member 110 to facilitate mounting of the can opener 100 onto the edge of a can. A latching knob 142 supported by a vertical leaf spring 143 from the casing 550 is engageable with the top handle member 120 through a hole 144 thereof to lock the top handle member 120 close upon the bottom handle member 110 against the action of the spring 141 to facilitate holding the two handle members 110 and 120 together during cutting operation.

The pawl 520 has a straight front end 521 and a crooked or hook-shaped rear end 522, taken in the driving direction D. The pawl 520 is hinged at its front end 521 at an off-center position (from axis X) to the base plate 540 for to-and-fro arcuate movement by the operating lever 400 (through cranking) about the ratchet wheel 510 rotatable about the center (axis X). In the driving direction D, the rear pawl end 522 engages like a hook with the asymmetrical teeth of the ratchet wheel 510 for turning the wheel 510. In the opposite direction, the rear pawl end 522 will upon return ride past the teeth of the ratchet wheel 510 without turning the wheel 510. In all, the ratchet wheel 510 (and hence the traction wheel 200 and cutter blade 300) will be turned stepwise in one direction D upon pivoting of the operating lever 400 in opposite directions.

Whilst the pawl 520 is hinged at its front end 521, the spring 530 acts directly upon the rear end 522 for optimal resilience to keep it in engagement with the teeth of the ratchet wheel 510. As the pawl 520 turns the ratchet wheel 510 by its rear end 522 through a pulling action, the chance that the pawl 520 gets jammed is remote. By lying generally parallel and close to the adjacent periphery of the ratchet wheel 510, the pawl 520 does not only take up minimum space but also turns the wheel 510 by acting almost tangentially thereupon to reduce loss of force in the radial direction.

Figure 8:
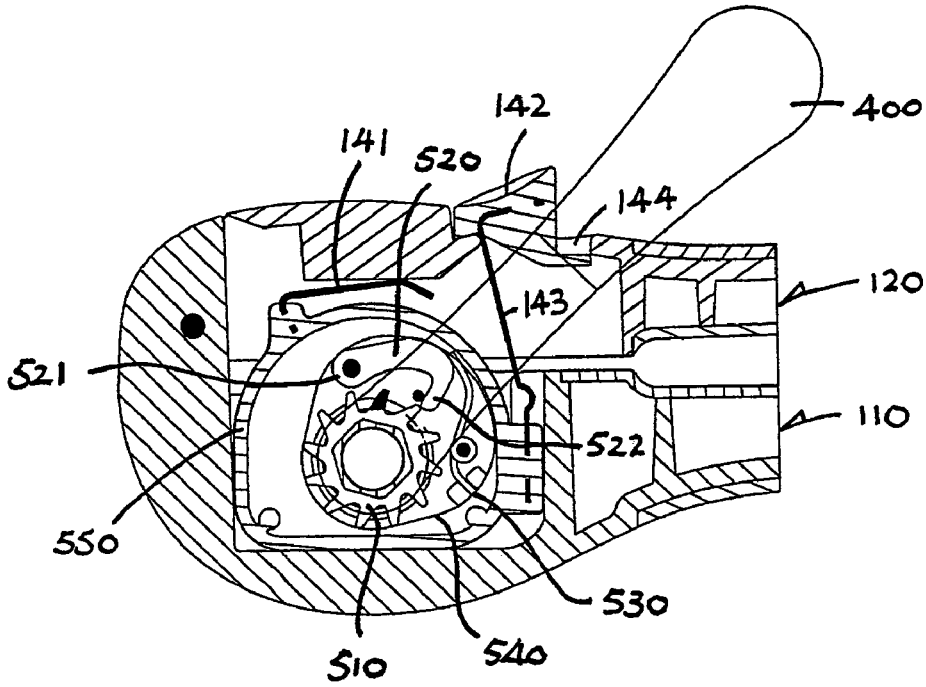
FIG. 8 is a cross-sectional view in part of FIG. 5, showing one operating condition of the can opener.
Figure 9:
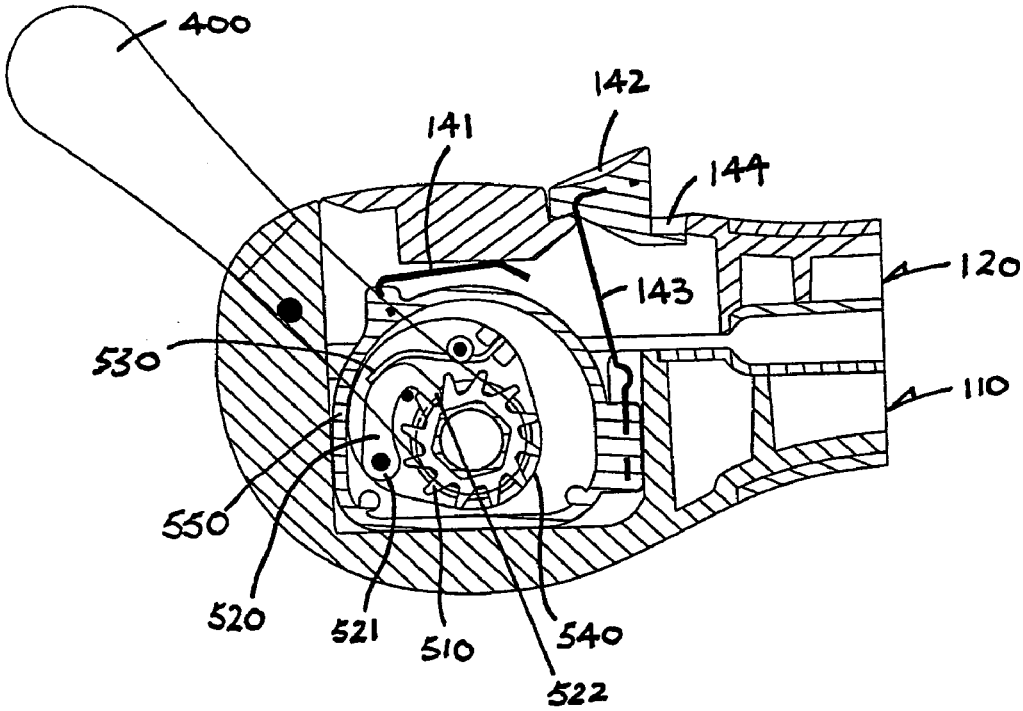
FIG. 9 is a cross-sectional view similar to FIG. 8, showing another operating condition.

The base plate 540 supports the ratchet wheel 510/512 and pawl 520 with spring 530 for pivotal movement within the casing 550, whose interior has a cross-section that restricts the pivotal movement of the base plate 540 and hence the operating lever 400 between rearmost (FIG. 8) and foremost (FIG. 9) positions spaced apart for just over an angle of 90° as shown. More specifically, an outer shoulder of the base plate 540 will at either extremity hit the peripheral wall of the casing 550 in that direction. In the preferred form, this limiting function is accomplished by the relative shapes of the base plate and the housing. It should be appreciated that a wide range of structures are contemplated in which a "shoulder" or other abutment of the base plate 540 can engage a stop or other surface within the casing 550 in order to limit rotational movement.

In operation, the can opener 100 is held by the left hand of a user grasping the two handle members 110 and 120, and the operating lever 400 is pivoted back-and-forth by the right hand. Every time the lever 400 is pivoted forward, the ratchet wheel 510 is turned by the pawl 520 to rotate the traction wheel 200 and cutter blade 300, thereby cutting open a can along its top edge. As the user can, and will, keep holding the lever 400 while pivoting it back-and-forth, operation is made easy.

The can to be opened is clamped by the wheel 200 and blade 300 on the left side of the can opener 100, that being a load on the left hand side of the can opener 100. The can opener 100 is operated by a user pivoting the lever 400 on the right hand side. The point of application of user's force is extended to the right (by means of the shaft 541) and this somewhat balances the load to the left, thereby making the can opener 100 feel more stable in use.

It is envisaged that the operating lever may be connected to the top handle member, in which case gears may be used between the lever and the ratchet assembly (in the bottom handle member) for transmitting drive across the handle members. In another aspect, more than one pawl may be used to turn the ratchet wheel for example two on opposite sides, and this offers balance and/or strength in drive transmission.

The invention has been given by way of example only, and various other modifications of and/or alterations to the described embodiment may be made by persons skilled in the art without departing from the scope of the invention as specified in the appended claims.

The invention claimed is:

1. A can opener comprising:

first and second handle members pivotally connected to each other;

a rotatable traction wheel and a rotatable cutter blade movable by the first and second handle members respectively between an inoperative position in which the wheel and the blade are spaced apart for receiving an edge of a can to be opened and an operative position in which the wheel and the blade are close together for turning and cutting the edge of said can;

an operating lever supported for pivotal reciprocation relative to the handle members;

a ratchet assembly arranged to be driven by the operating lever upon reciprocation for operating the traction wheel and the cutter blade, the ratchet assembly comprising a ratchet wheel in engagement with the traction wheel and a spring-loaded pawl movable by the operating lever for turning the ratchet wheel in a driving direction upon reciprocation of the operating lever, wherein the pawl has front and rear portions taken in the driving direction, with the front portion operably connected to the operating lever and the rear portion engaged with the ratchet wheel for turning the ratchet wheel, wherein at least one of the first and second handle members further comprises a front end portion forming a chamber and wherein the ratchet assembly is mounted within the chamber; and a casing mounted within the chamber, wherein the ratchet assembly is housed within the casing.

2. The can opener of claim 1, wherein the ratchet assembly further comprises a base assembly operably connected to the operating lever via a shaft extending along an operating axis, the pawl and ratchet wheel being mounted on the base, and further wherein the base and ratchet assembly are substantially sealed within the casing.

3. The can opener of claim 1, further comprising a lock releasably engaged with the first handle or the second handle for holding the first handle and second handle adjacent to one another.

4. A can opener comprising:

first and second handles pivotally connected to each other, at least one of the first and second handles defining a chamber adjacent the pivotal connection;

a rotatable traction wheel and a rotatable cutter blade movable by the first and second handles respectively between an inoperative position in which the wheel and the blade are spaced apart for receiving an edge of a can to be opened and an operative position in which the wheel and the blade are close together for turning and cutting the edge of said can;

an operating lever supported for pivotal reciprocation relative to the handles;

a ratchet assembly arranged to be driven by the operating lever upon reciprocation and coupled to the traction wheel for operating the traction wheel and the cutter blade, the ratchet assembly being housed within the chamber and comprising a pawl engaged with a ratchet wheel, wherein the operating lever engagably operates the pawl to turn the ratchet wheel in a driving direction; and a casing mounted within the chamber, wherein the ratchet assembly is housed within the casing.

5. The can opener of claim 4, wherein the ratchet assembly further comprises a base operably connected to the operating lever via a shaft extending along an operating axis, the pawl and ratchet wheel being mounted on the base, and further wherein the base and ratchet assembly are substantially sealed within the casing.

6. The can opener of claim 4, further comprising a lock releasably engaged with the first handle or the second handle for holding the first handle and second handle adjacent to one another.

7. The can opener of claim 4, wherein the base is fixedly connected to the operating lever and the pawl has front and rear portions taken in the driving direction, with the front portion operably connected to the base and the rear portion engaged with the ratchet wheel for turning the ratchet wheel, whereby movement of the operating lever in a first direction causes pivotal movement of the base in the first direction and accompanying sliding of the rear portion of the pawl over the ratchet wheel, and movement of the operating lever in a second direction causes pivotal movement of the base in the second direction and accompanying rotation of the ratchet wheel via pulling engagement of the pawl against the traction wheel.

8. The can opener of claim 7, wherein the base further comprises a shoulder configured for engagement against a surface of the casing to limit rotational movement of the base in at least one of the first direction and the second direction.

* * * * *